US008892277B2

(12) United States Patent
Shiota et al.

(10) Patent No.: US 8,892,277 B2
(45) Date of Patent: Nov. 18, 2014

(54) VEHICLE AIR-CONDITIONING CONTROL METHOD

(75) Inventors: Hiroyuki Shiota, Tokyo (JP); Hidetaka Adachi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 316 days.

(21) Appl. No.: 13/382,744

(22) PCT Filed: Jul. 22, 2009

(86) PCT No.: PCT/JP2009/063087

§ 371 (c)(1),
(2), (4) Date: Jan. 6, 2012

(87) PCT Pub. No.: WO2011/010369

PCT Pub. Date: Jan. 27, 2011

(65) Prior Publication Data

US 2012/0109429 A1 May 3, 2012

(51) Int. Cl.
*B61D 27/00* (2006.01)

(52) U.S. Cl.
CPC ..... *B61D 27/0072* (2013.01)
USPC ..... 701/19; 701/36

(58) Field of Classification Search
CPC ..... B61D 27/0072; B61D 27/00; B61D 27/0009; B61D 27/0045; B61D 27/0054; B61D 27/0063
USPC ..... 701/19, 36
See application file for complete search history.

(56) References Cited

U.S. PATENT DOCUMENTS

| | | | | |
|---|---|---|---|---|
| 2,469,555 | A * | 5/1949 | Hitchcock | 342/367 |
| 5,104,037 | A * | 4/1992 | Karg et al. | 236/46 R |
| 5,462,481 | A | 10/1995 | Riedel et al. | |
| 2004/0152408 | A1 | 8/2004 | Eckhardt | |

FOREIGN PATENT DOCUMENTS

| | | | |
|---|---|---|---|
| DE | 26 33 243 | A1 | 2/1977 |
| EP | 0 149 450 | A2 | 7/1985 |
| EP | 0 610 692 | A1 | 8/1994 |
| GB | 2 267 146 | A | 11/1993 |

(Continued)

OTHER PUBLICATIONS

Machine translation of JP 3842688 translated Dec. 31, 2013.*

(Continued)

*Primary Examiner* — John Q Nguyen
*Assistant Examiner* — Alan D Hutchinson
(74) *Attorney, Agent, or Firm* — Buchanan Ingersoll & Rooney PC

(57) ABSTRACT

A vehicle air-conditioning control method includes: calculating an air-conditioning reference temperature for an interior of a vehicle on the basis of an in-vehicle temperature measured by an in-vehicle temperature sensor provided inside a vehicle that runs between stations, an outside air temperature measured by an outside air temperature sensor provided on the exterior of the vehicle, an in-vehicle humidity measured by a humidity sensor provided inside the vehicle, and a vehicle occupancy rate measured by a load-compensating sensor provided in the vehicle; determining an air-conditioning control pattern for performing air-conditioning of the inside of the vehicle on the basis of the air-conditioning reference temperature; and controlling a vehicle air-conditioning apparatus on the basis of the air-conditioning control pattern, wherein the data of a preceding vehicle is received, and is used in air-conditioning control of a following vehicle.

13 Claims, 7 Drawing Sheets

(56) References Cited

FOREIGN PATENT DOCUMENTS

| | | | |
|---|---|---|---|
| JP | 63-207766 | A | 8/1988 |
| JP | 6-064536 | A | 3/1994 |
| JP | 10-059178 | A | 3/1998 |
| JP | 2000-071740 | A | 3/2000 |
| JP | 2001-030903 | A | 2/2001 |
| JP | 2001-088699 | A | 4/2001 |
| JP | 2002-284005 | A | 10/2002 |
| JP | 2003-285637 | A | 10/2003 |
| JP | 2003-312474 | A | 11/2003 |
| JP | 2004-291899 | A | 10/2004 |
| JP | 2005-178426 | A | 7/2005 |
| JP | 3842688 | B2 | 8/2006 |
| JP | 2007-083872 | A | 4/2007 |
| JP | 2009-007006 | A | 1/2009 |
| WO | 02/074600 | A1 | 9/2002 |

OTHER PUBLICATIONS

International Search Report (PCT/ISA/210) issued on Oct. 27, 2009, by Japanese Patent Office as the International Searching Authority for International Application No. PCT/JP2009/063087.

Office Action (Notification of Reasons for Refusal) dated Jun. 19, 2012, issued in corresponding Japanese Patent Application No. 2011-523509, and an English Translation thereof. (5 pages).

Office Action (Notification of the First Office Action) issued on Nov. 5, 2013, by the Chinese Patent Office in corresponding Chinese Patent Application No. 200980160525.9, and an English Translation of the Office Action. (7 pages).

Extended European Search Report dated Sep. 26, 2013, issued by the European Patent Office in corresponding European Patent Application No. 09847554.4-1754 / 2457797. (5 pages).

* cited by examiner

VEHICLE AIR-CONDITIONING CONTROL METHOD

TECHNICAL FIELD

The present invention relates to a vehicle air-conditioning control method for controlling air-conditioning of the interior of a railway vehicle.

BACKGROUND ART

Generally known examples of a vehicle air-conditioning control method include that shown in FIG. 10. That is, in the vehicle air-conditioning control method of the related art, as shown in FIG. 10, electric power input from a pantograph 23 is supplied to an auxiliary power-supply device 24, whereby an air-conditioning power is generated and is supplied to an air-conditioning apparatus 25. The air-conditioning apparatus 25 uses an air-conditioning control apparatus 26 so as to control the number of operating units, the operating frequency, and the running time of air-conditioning compressors inside the air-conditioning apparatus 25, or so as to control the running speed of an electric motor of an indoor fan, thereby performing air-conditioning performance control.

The air-conditioning control apparatus 26 has a microcomputer incorporated thereinto, and an air-conditioning reference temperature stored in a storage area is subjected to various corrections and is sequentially calculated. The various corrections are calculated on the basis of an in-vehicle temperature measured by an in-vehicle temperature sensor 28 provided inside the vehicle, an outside air temperature measured by an outside air temperature sensor 30 provided on the exterior of the vehicle, an in-vehicle humidity measured by a humidity sensor 29 provided inside the vehicle, and the occupancy rate of this vehicle, which is measured by a load-compensating sensor 31 provided in the vehicle.

Hitherto, regarding vehicle occupancy rate and outside air temperature, the vehicle occupancy rate and the outside air temperature when a vehicle is running are measured. Furthermore, there is a method in which inter-station vehicle occupancy rate information for each time zone, which is created in advance on the basis of actual results, has been stored in storage means as inter-station vehicle occupancy rate information on a day of the week basis, on a day of the month basis, on a vehicle operation form basis, or on a vehicle basis (see, for example, PTL 1).

In addition, there is a method in which control of air-conditioning performance is performed on the basis of an air-conditioning load, which is predicted on the basis of the environment information at the present time and the environment information stored in the past (see, for example, PTL 2).

In addition, there is a method in which data including the driving information on an air conditioner and the position information of the vehicle is transmitted periodically to a management computer, and the management computer stores the data and performs processing (see, for example, PTL 3).

CITATION LIST

Patent Literature

PTL 1: Japanese Patent No. 3842688

PTL 2: Japanese Unexamined Patent Application Publication No. 2000-071740

PTL 3: Japanese Unexamined Patent Application Publication No. 2009-7006

SUMMARY OF INVENTION

Technical Problem

However, such a vehicle air-conditioning control method of the related art has the following problems.

In a case where correction of an air-conditioning reference temperature is to be performed on the basis of a vehicle occupancy rate when a vehicle is running, since temperature control is performed in such a way that the number of operating units of air-conditioning compressors incorporated into an air-conditioning apparatus, the operating frequency thereof, and the driving time period thereof are controlled after correction is performed, or the running speed of an electric motor of an indoor fan is controlled so as to make the temperature inside the vehicle approach the air-conditioning reference temperature, it takes time from when the vehicle arrives at the next station until a target air-conditioning reference temperature at which passengers feel comfortable is reached after the vehicle occupancy rate changes.

Furthermore, in a case where correction of an air-conditioning reference temperature is to be performed on the basis of inter-station vehicle occupancy rate information for each time zone, which is created in advance on the basis of actual results stored in storage means in which inter-station vehicle occupancy rate information on a day of the week basis, on a day of the month basis, on a vehicle operation form basis, or on a vehicle basis is stored, there is a problem that a database that stores the information becomes large, hardware and software that predict an inter-station vehicle occupancy rate and the like are necessary, and it takes a lot of time to perform calculation processes. Furthermore, the stored inter-station vehicle occupancy rate has a problem in that a reliable vehicle occupancy rate cannot be predicted, and the inside of the vehicle cannot be air-conditioned comfortably.

In addition, also, in means for predicting an air-conditioning load on the basis of the environment information stored in the past, there is a problem that the database becomes large, hardware and software that predict an air-conditioning load on the basis of environment information are necessary, and it takes a lot of time to perform calculation processes.

The present invention is made to solve, problems described above.

Solution to Problem

The vehicle air-conditioning control method according to the present invention is a vehicle air-conditioning control method including: calculating an air-conditioning reference temperature for an interior of a vehicle on the basis of an in-vehicle temperature measured by an in-vehicle temperature sensor provided inside a vehicle that runs between stations, an outside air temperature measured by an outside air temperature sensor provided on the exterior of the vehicle, an in-vehicle humidity measured by a humidity sensor provided inside the vehicle, and a vehicle occupancy rate measured by a load-compensating sensor provided in the vehicle; determining an air-conditioning control pattern for performing air-conditioning of the inside of the vehicle on the basis of the air-conditioning reference temperature; and controlling a vehicle air-conditioning apparatus on the basis of the air-conditioning control pattern. The data of a preceding vehicle, which is measured between the next station and the station after the next station for a following vehicle, is transmitted to the following vehicle from a same train car of the preceding vehicle on the same line, which is assumed to be substantially the same environment as that in which the following vehicle is placed. The change of the air-conditioning control pattern based on the change of air-conditioning performance is performed before the arrival at the next station on the basis of the data received by the following vehicle. On the basis of the changed air-conditioning control pattern, a vehicle air-conditioning apparatus, in which the number of operating units of air-conditioning compressors incorporated thereinto, the operating frequency thereof, and the running time thereof are controlled, or a running speed of an electric motor of an indoor fan is controlled, the vehicle air-conditioning apparatus being mounted in the following vehicle, controls an air-conditioning apparatus so as to make the interior of the vehicle comfortable when the following vehicle departs from the next station.

Advantageous Effects of Invention

According to the present invention of the vehicle air-conditioning control method, by taking means such as the above, a preceding vehicle transmits data detected thereby to a following vehicle, and the following vehicle creates an optimum in-vehicle environment on the basis of the data.

DESCRIPTION OF EMBODIMENTS

Embodiment 1

Figure 1:
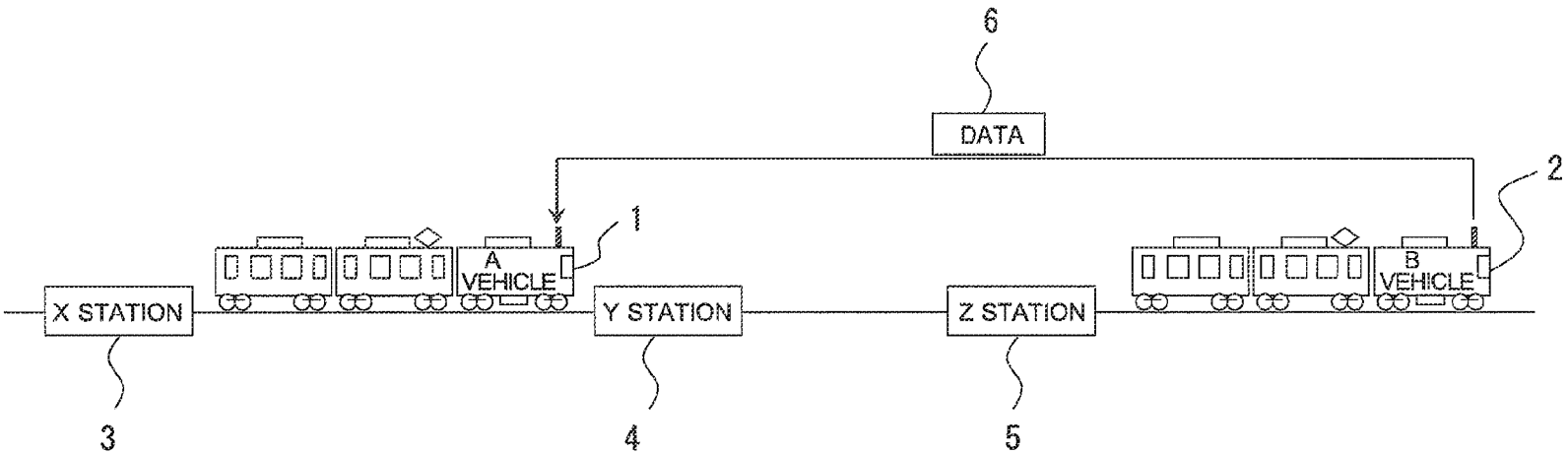
FIG. 1 is a conceptual view illustrating an example of the configuration of a vehicle to which a vehicle air-conditioning control method according to Embodiment 1 of the present invention is applied.
Figure 2:
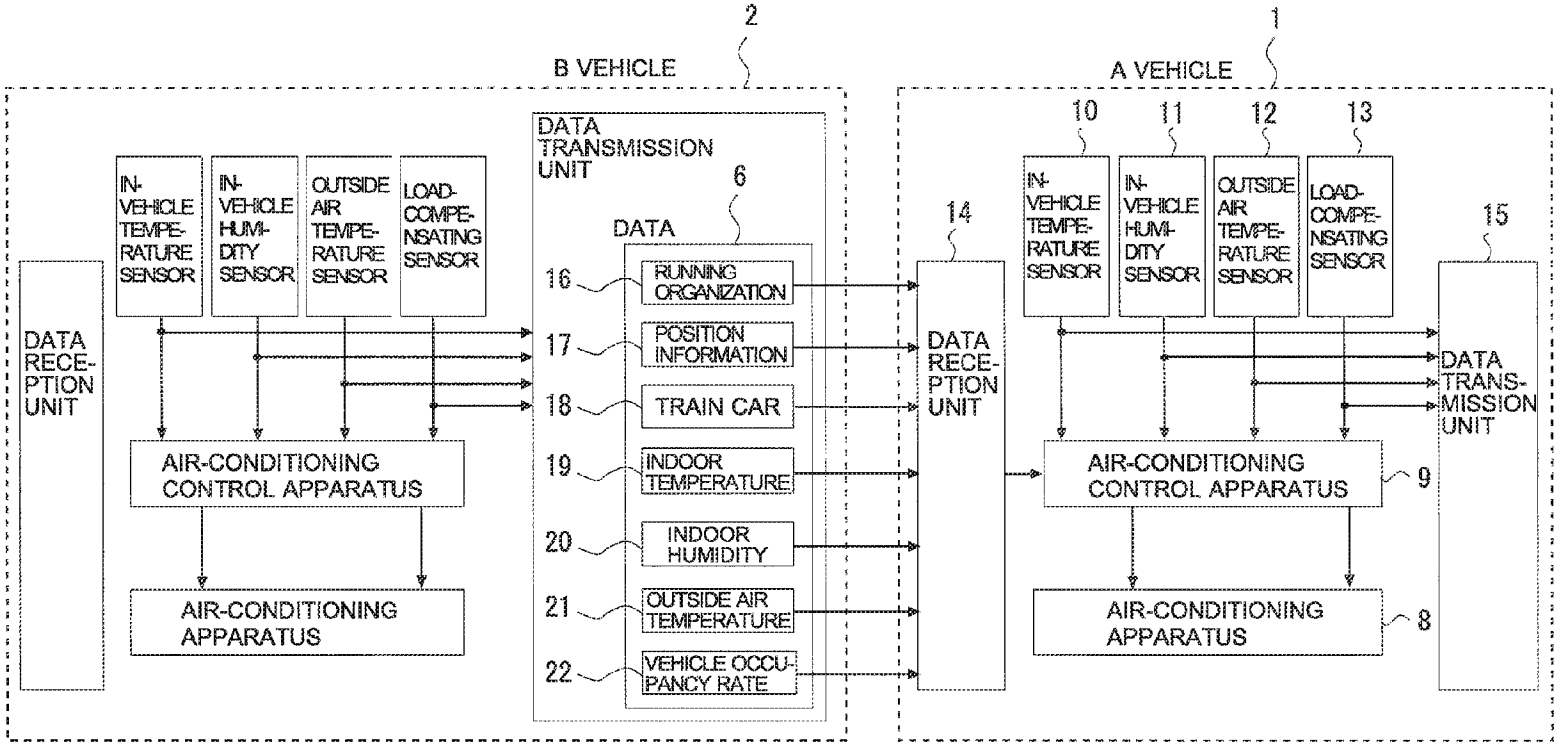
FIG. 2 is a block diagram illustrating an example of the configuration of a vehicle air-conditioning control apparatus to which the vehicle air-conditioning control method according to Embodiment 1 of the present invention is applied.

FIG. 1 is a conceptual view illustrating an example of the configuration of a vehicle to which a vehicle air-conditioning control method according to Embodiment 1 of the present invention is applied, and FIG. 2 is a functional block diagram illustrating an example of the configuration of a vehicle air-conditioning control apparatus to which the vehicle air-conditioning control method according to Embodiment 1 of the present invention is applied.

In FIGS. 1 and 2, a vehicle air-conditioning control apparatus for A vehicle 1 that runs between an X station 3 and a Y station 4, to which the vehicle air-conditioning control method according to the present embodiment is applied, includes an air-conditioning apparatus 8, an air-conditioning control apparatus 9, an in-vehicle temperature sensor 10, an in-vehicle humidity sensor 11, an outside air temperature sensor 12, a load-compensating sensor 13, a data receiving unit 14 for receiving data 6 obtained between the Y station 4 that is a station next to the X station 3 and a Z station 5 that is a station next to the Y station 4, which is transmitted from another B vehicle 2 on the same vehicle operation form basis, which runs on the same line and directly ahead of the A vehicle 1, and a transmission unit 15 through which the A vehicle 1 transmits data to a vehicle that follows on the same line in the same manner as for the data 8 that is transmitted by the B vehicle 2.

Examples of the data 6 of the B vehicle 2, which is received by the data receiving unit 14, include a vehicle operation form 16 of the B vehicle 2, position information 17 of the B vehicle 2, information on each train car 18 of the B vehicle 2, an in-vehicle temperature 19 in each train car 18, an in-vehicle humidity 20 in each train car 18, an outside air temperature 21 in each train car 18, and a vehicle occupancy rate 22 in each train car 18.

Among the above, the air-conditioning apparatus 8, the air-conditioning control apparatus 9, the in-vehicle temperature sensor 10, and the in-vehicle humidity sensor 11 are provided for each vehicle. Although FIG. 2 illustrates a configuration in which the outside air temperature sensor 12, the load-compensating sensor 13, the data receiving unit 14, and the data transmission unit 15 are provided for each vehicle, the outside air temperature sensor 12, the load compensating sensor 13, the data receiving unit 14, and the data transmission unit 15 may be included for each train.

FIG. 2 illustrates a configuration in which, regarding the data 6 transmitted to the data receiving unit 14, the in-vehicle temperature 19 in the train car 18, the in-vehicle humidity 20 in the train car 18, the outside air temperature 21 in the train car 18, and the vehicle occupancy rate 22 in the train car 18 are transmitted; instead of the in-vehicle temperature 19, a signal output from the in-vehicle temperature sensor may be used, instead of the in-vehicle humidity 20, a signal output from the in-vehicle humidity sensor may be used, instead of the outside air temperature 21, a signal output from the outside air temperature sensor may be used, and instead of the vehicle occupancy rate 22, a signal output from the load-compensating sensor may be used.

Figure 3:
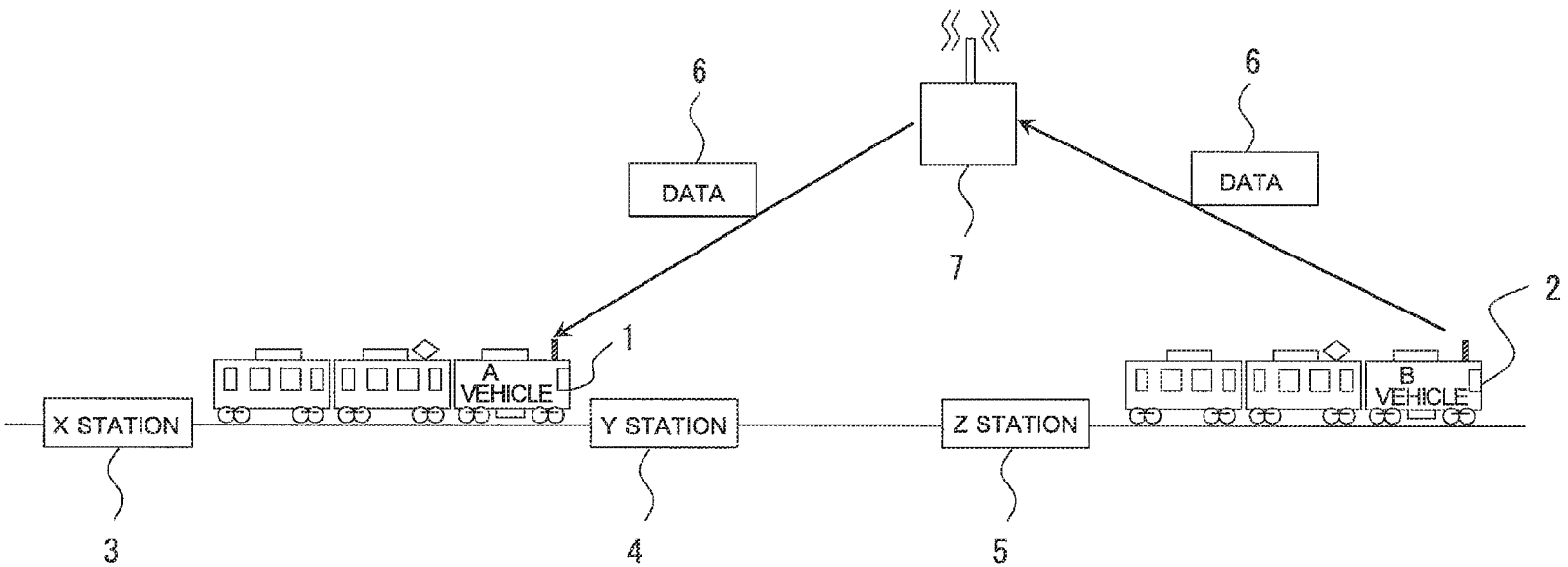
FIG. 3 is a block diagram illustrating an example of the configuration of a vehicle air-conditioning control apparatus to which the vehicle air-conditioning control method according to Embodiment 1 of the present invention is applied.

In addition, in FIGS. 1 and 2, the data 6 is transmitted directly from the B vehicle 2 to the A vehicle 1; as in FIG. 3, the data 6 may be transmitted to the A vehicle 1 via a terrestrial service computer 7.

Descriptions will be given below, with reference to FIG. 2, to an embodiment of a vehicle air-conditioning control apparatus to which the vehicle air-conditioning control method that is configured in this manner is applied.

The in-vehicle temperature sensor 10 of the A vehicle 1, which is provided inside the vehicle, measures the temperature inside the vehicle, and outputs an in-vehicle temperature sensor signal, which is the result of the measurement, to the air-conditioning control apparatus 9 of the A vehicle 1.

The in-vehicle humidity sensor 11 of the A vehicle 1, which is provided inside the vehicle, measures the humidity inside the vehicle, and outputs an in-vehicle humidity sensor signal, which is the result of the measurement, to the air-conditioning control apparatus 9 of the A vehicle 1.

The outside air temperature sensor 12 of the A vehicle 1, which is provided on the exterior of the vehicle, measures the temperature on the exterior of the vehicle, and outputs an outside air temperature sensor signal, which is the result of the measurement, to the air-conditioning control apparatus 9 of the A vehicle 1.

The load-compensating sensor 13 of the A vehicle 1, which is provided in the vehicle, detects the occupancy rate of the vehicle, and outputs a vehicle occupancy rate signal, which is the result of the measurement, to the air-conditioning control apparatus 9 of the A vehicle 1. For the load-compensating sensor 13, sensors in general use may be used and, for example, an electrical load-compensating sensor or a mechanical load-compensating sensor may be used.

Before a predetermined time prior to the time when the A vehicle 1 is expected to arrive at the Y station 4 next, the air-conditioning control apparatus 9 of the A vehicle 1 predicts the air-conditioning reference temperature when the A vehicle 1 will be running between the Y station 4 at which the A vehicle 1 arrives next, and the Z station 5 which is the station after the Y station on the basis of the data 6, such as the outside air temperature 21 and the vehicle occupancy rate 22 received from the B vehicle 2.

Then, the air-conditioning apparatus 8 is controlled on the basis of an air-conditioning control pattern corresponding to the air-conditioning reference temperature. However, in a case where the B vehicle 2 runs apart from the A vehicle 1 by a certain time (for example, 30 minutes) or more, the environments of the B vehicle 2 and the A vehicle 1 may have changed, and the embodiment is not performed. This time can be changed.

Figure 4:
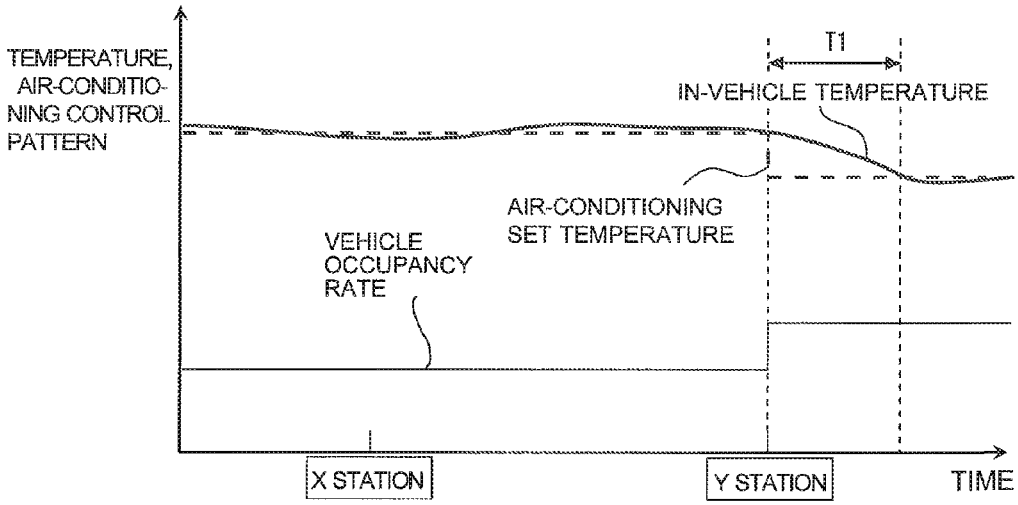
FIG. 4 illustrates an example of the in-vehicle temperature and the change behavior of an air-conditioning control pattern when a vehicle air-conditioning control method of the related art is performed.

If, as in the related art, the air-conditioning reference temperature between the Y station 4 and the Z station 5 at the point of departure from the Y station 4 is set, the air-conditioning control pattern is changed, and the air-conditioning apparatus is controlled, it takes a time of T1 until the actual in-vehicle temperature reaches the air-conditioning reference temperature as shown in FIG. 4. During this time of T1, since the inside of the vehicle reaches a temperature higher than a comfortable air-conditioning reference temperature, passengers feel uncomfortable.

Figure 5:
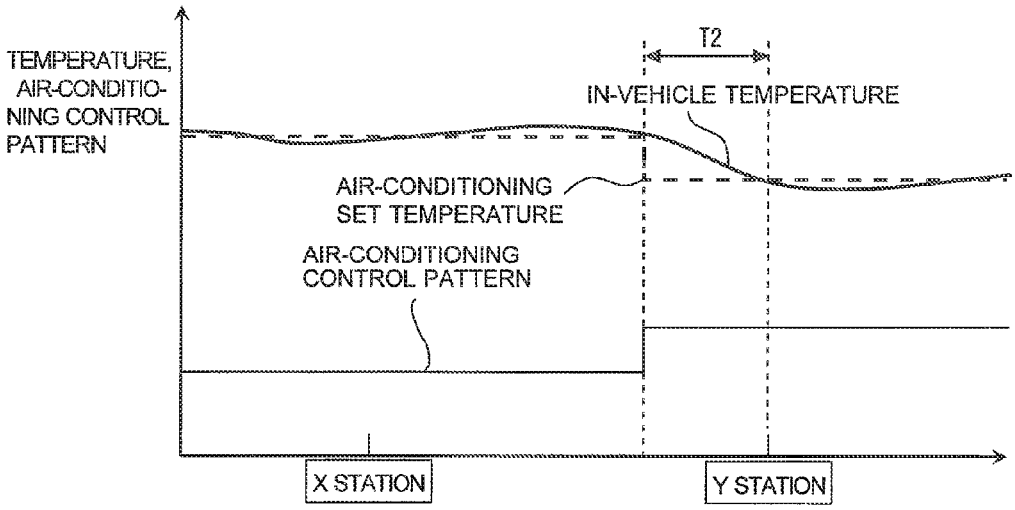
FIG. 5 illustrates an example of the in-vehicle temperature and the change behavior of an air-conditioning control pattern when the vehicle air-conditioning control method according to Embodiment 1 of the present invention is applied.

In a case where Embodiment 1 is applied, as shown in FIG. 5, the air-conditioning reference temperature is changed before a predetermined time T2 prior to the expected arrival time to the Y station 4, and the air-conditioning control pattern is changed. Since the in-vehicle temperature of the A vehicle 1 reaches the air-conditioning reference temperature, which is for the vehicle to run through the Y station 4 and the Z station 5, at the time of arrival to the Y station 4, it is possible to prevent the in-vehicle environment from becoming an uncomfortable environment. The predetermined time T2 can be changed.

Since the vehicle air-conditioning control apparatus to which the vehicle air-conditioning control method according to Embodiment 1 has such a configuration as described above, it is possible to change, before the vehicle arrives at the next station, the air-conditioning control pattern to an air-conditioning control pattern corresponding to the air-conditioning reference temperature when the vehicle runs between the next station and the station after the next station. As a result, from the point when the vehicle arrives at the next station and departs from the next station, comfortable air-conditioning of the inside of the vehicle can be performed.

Embodiment 2

Figure 6:
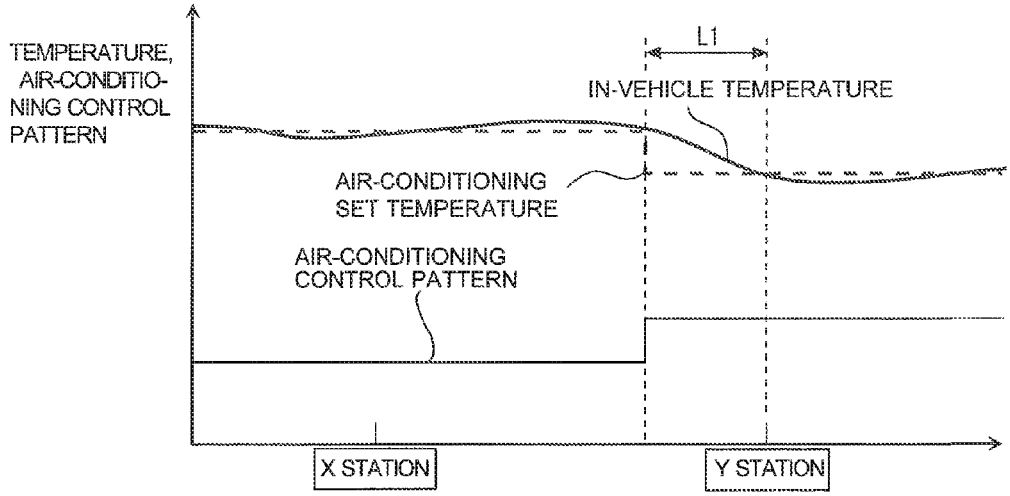
FIG. 6 illustrates an example of the in-vehicle temperature and the change behavior of an air-conditioning control pattern when a vehicle air-conditioning control method according to Embodiment 2 of the present invention is applied.

Embodiment 2 will be described with reference to FIG. 6.

Although, in Embodiment 1, the timing at which the air-conditioning reference temperature is changed is set to be before the predetermined time prior to the arrival to the Y station 4, in Embodiment 2, the air-conditioning reference temperature is changed before a predetermined distance L1 from the Y station 4. The other points are the same as those described in Embodiment 1. The predetermined distance L1 can be changed.

Embodiment 3

Embodiment 3 will be described with reference to FIGS. 2, 7 and 8.

In Embodiments 1 and 2 described above, the A vehicle 1 that follows changes the air-conditioning reference temperature on the basis of the data 6 received from the B vehicle 2 that runs ahead of the A vehicle 1. However, in a vehicle air-conditioning control apparatus to which Embodiment 3 is applied, when the position information 17 and the outside air temperature 21 are received from a preceding vehicle and the outside air temperature changes suddenly, a running speed of a ventilation fan is changed before a predetermined time prior to the time when the vehicle reaches the position at which the outside air temperature increases.

Figure 7:
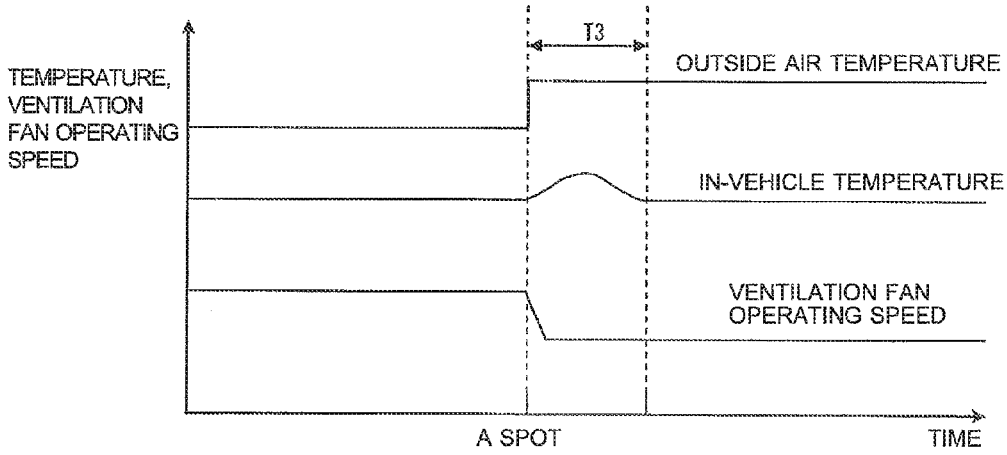
FIG. 7 illustrates an example of the change behavior of an in-vehicle temperature, the speed pattern of a ventilation fan, and the presence or absence of a tunnel when a vehicle air-conditioning control method of the related art is performed.

In a case where a running vehicle enters a tunnel at an A spot and the outside air temperature increases suddenly, for example, and the vehicle air-conditioning control method of the related art is used, since the in-vehicle temperature increases for the time period of T3 as shown in FIG. 7, passengers feel uncomfortable.

Figure 8:
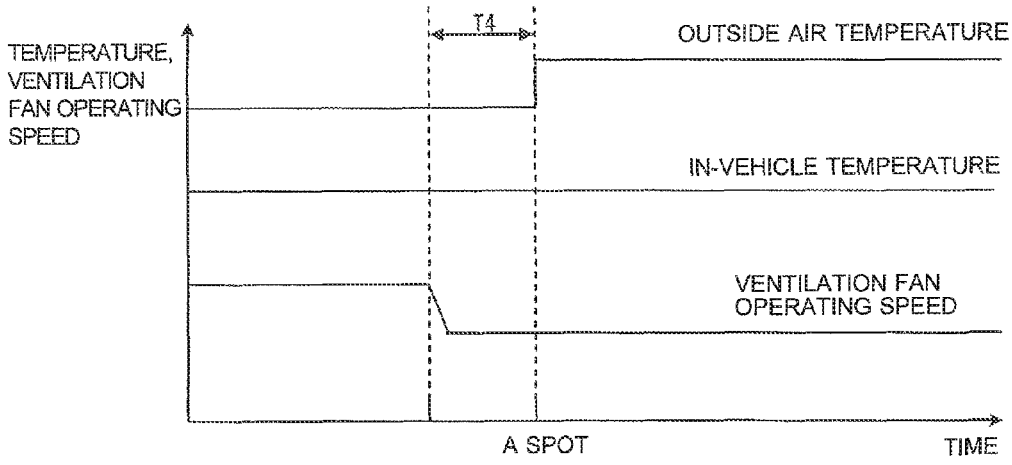
FIG. 8 illustrates an example of the change behavior of an in-vehicle temperature, the speed pattern of a ventilation fan, and the presence or absence of a tunnel when a vehicle air-conditioning control method according to Embodiment 3 of the present invention is applied.

In a case where Embodiment 3 is applied, as shown in FIG. 8, when the running speed of the ventilation fan is controlled before a predetermined time 14 prior to the time when the vehicle arrives at the A spot at which the outside air temperature increases suddenly, it is possible to prevent the in-vehicle temperature from increasing even after the vehicle arrives at the A spot. The predetermined time T4 can be changed.

Furthermore, in the above description, the running speed of the ventilation fan is controlled. However, the opening/closing of a damper provided in an outside air intake opening may be controlled, or the running speed of the indoor fan may be controlled.

Embodiment 4

Figure 9:
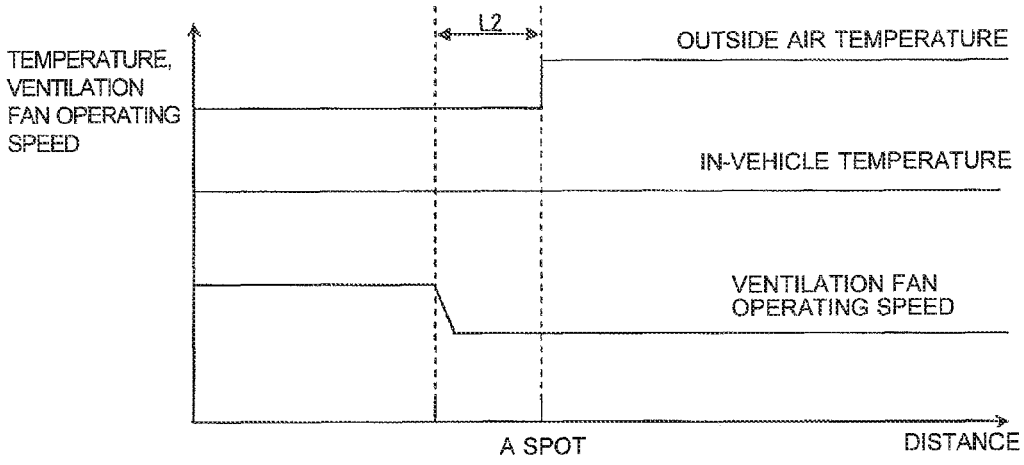
FIG. 9 illustrates an example of the change behavior of an in-vehicle temperature, the speed pattern of a ventilation fan, and the presence or absence of a tunnel when a vehicle air-conditioning control method according to Embodiment 4 of the present invention is applied.
Figure 10:
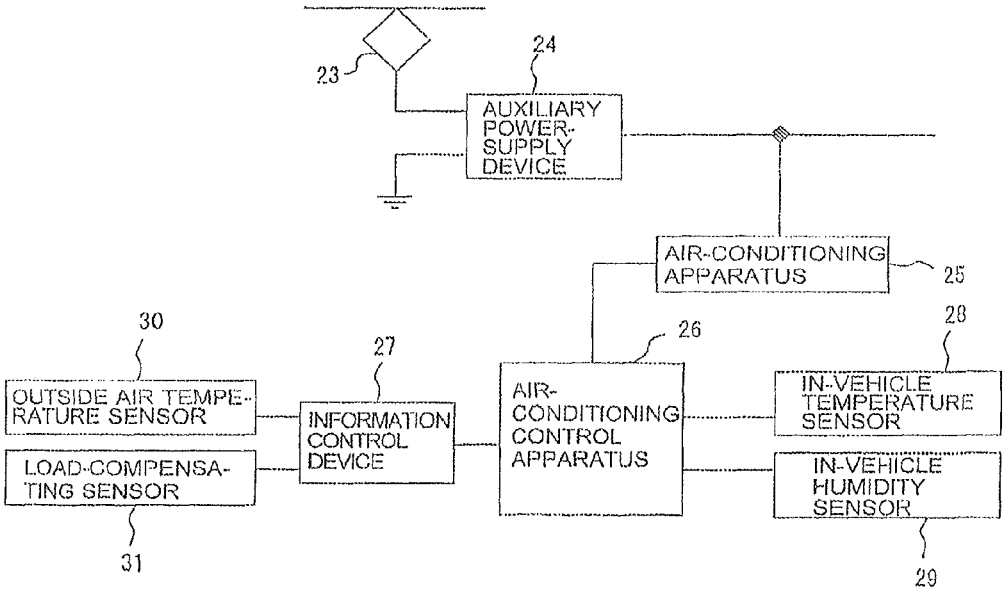
FIG. 10 is a block diagram illustrating a vehicle air-conditioning control apparatus of the related art.

A description will be given below, with reference to FIG. 9, of Embodiment 4.

In Embodiment 3 described above, the timing at which the running speed of the ventilation fan is changed is set to be before the predetermined time prior to the time when the outside air temperature increases suddenly. However, in Embodiment 4, the running speed of the ventilation fan is changed before a predetermined distance L2 from the spot where the outside air temperature increases suddenly. The other points are the same as those described in Embodiment 3. The predetermined distance L2 can be changed.

Although preferred Embodiments 1 to 4 of the present invention have been described in the foregoing while referring to the accompanying drawings, the present invention is not limited to such configurations. A person skilled in the art can conceive various changes or modifications within the scope of the technical concept described in the claims, and it should be understood that those changes or modifications fall within the technical scope of the present invention.

REFERENCE SIGNS LIST

A vehicle, 2 B vehicle, 3 X station, 4 Y station, 5 Z station, 6 data transmitted from B vehicle, 7 service computer, 8 air-conditioning apparatus, 9 air-conditioning control apparatus, 10 in-vehicle temperature sensor, 11 in-vehicle humidity sensor, 12 outside air temperature sensor, 13 load-compensating sensor, 14 data receiving unit, 15 data transmission unit, 16 vehicle operation form information, 17 mileage information, 18 train car information, 19 in-vehicle temperature, 20 in-vehicle humidity, 21 outside air temperature, 22 vehicle occupancy rate, 23 pantograph, 24 auxiliary power-supply device, 25 air-conditioning apparatus, 26 air-conditioning control apparatus, 27 information control device, 28 vehicle temperature sensor, 29 outside air temperature sensor, 30 outside air temperature sensor, 31 load-compensating sensor

The invention claimed is:

1. A vehicle air-conditioning control method comprising:

calculating an air-conditioning reference temperature for an interior of a vehicle that runs between stations on the basis of an in-vehicle temperature measured by an in-vehicle temperature sensor provided inside the vehicle, an outside air temperature measured by an outside air temperature sensor provided on the exterior of the vehicle, an in-vehicle humidity measured by a humidity sensor provided inside the vehicle, and a vehicle occupancy rate measured by a load-compensating sensor provided in the vehicle;

determining an air-conditioning control pattern for performing air-conditioning of the inside of the vehicle on the basis of the air-conditioning reference temperature; and controlling a vehicle air-conditioning apparatus of the vehicle on the basis of the air-conditioning control pattern, wherein data of a preceding vehicle is received, and is used in air-conditioning control of the vehicle, and wherein the data is obtained from a sensor disposed on a train car of the preceding vehicle having a same relative car number position as the car of the vehicle.

2. The vehicle air-conditioning control method of claim 1, wherein when the difference between an in-vehicle temperature between a next station for the vehicle and a station after the next station for the vehicle and the air-conditioning reference temperature is predicted to exceed a predetermined value, the air-conditioning control pattern is changed to an air-conditioning control pattern, which is based on an in-vehicle temperature between the next station and the station after the next station, before a predetermined time prior to the expected arrival time of the vehicle to the next station, and the air-conditioning of the inside of the vehicle is performed by controlling the vehicle air-conditioning apparatus.

3. The vehicle air-conditioning control method of claim 1, wherein said sensor is an in-vehicle temperature sensor, the in-vehicle temperature measured by in-vehicle temperature sensor provided inside a train car of the preceding vehicle that is on the same line of the vehicle and has already traveled between a next station for the vehicle and a station after the next station for the vehicle is received by the vehicle before a predetermined time prior to the expected arrival time to the next station, the air-conditioning control pattern of a train car of the vehicle having a same relative car number position as the train car of the preceding vehicle is changed to an air-conditioning control pattern based on the received in-vehicle temperature before the predetermined time prior to the expected arrival time to the next station, and air-conditioning of the vehicle is performed by controlling the vehicle air-conditioning apparatus.

4. The vehicle air-conditioning control method of claim 2, wherein said sensor is an in-vehicle humidity sensor, in-vehicle humidity measured by said humidity sensor provided inside a train car of the preceding vehicle that has already traveled between the next station for the vehicle and the station after the next station for the vehicle is received by the vehicle, and the air-conditioning control pattern of a train car of the vehicle having a same relative car number position as the train car of the preceding vehicle to be changed before the predetermined time period is calculated using the received in-vehicle humidity.

5. The vehicle air-conditioning control method of claim 2, wherein said sensor is an outside temperature sensor, outside air temperature measured by said outside air temperature sensor provided on the exterior of a train car of the preceding vehicle that has already traveled between the next station for the vehicle and the station after the next station for the vehicle is received by the vehicle, and the air-conditioning control pattern of a train car of the vehicle having a same relative car number position as the train car of the preceding vehicle to be changed before the predetermined time is calculated using the received outside air temperature.

6. The vehicle air-conditioning control method of claim 2, wherein said sensor is a load-compensating sensor, vehicle occupancy rate measured by said load-compensating sensor provided in a train car of the preceding vehicle that has already traveled between the next station for the vehicle and the station after the next station for the vehicle is received by the vehicle, and the air-conditioning control pattern of a train car of the vehicle having a same relative car number position as the train car of the preceding vehicle to be changed before the predetermined time is calculated using the received vehicle occupancy rate.

7. The vehicle air-conditioning control method of claim 2, wherein a plurality of data are received from among an in-vehicle temperature measured by an in-vehicle temperature sensor provided inside a train car of the preceding vehicle that is on the same line as the vehicle and has already traveled between a next station for the vehicle and a station after the next station for the vehicle, an in-vehicle humidity measured by a humidity sensor provided inside the preceding vehicle, an outside air temperature measured by an outside air temperature sensor provided on the exterior of the preceding vehicle, and the vehicle occupancy rate measured by the load-compensating sensor provided in the preceding vehicle, and the air-conditioning control pattern of a train car of the vehicle having a same relative car number position as the train car of the preceding vehicle to be changed before the predetermined time is calculated using the plurality of received data.

8. The vehicle air-conditioning control method of claim 2, wherein the air-conditioning control pattern is changed before a predetermined distance from the next station rather than before the predetermined time prior to the expected arrival time to the next station.

9. The vehicle air-conditioning control method of claim 1, wherein the vehicle receives position information and an outside air temperature of a spot at which an outside air temperature increases or drops suddenly for a train car of the preceding vehicle that precedes on the same line, and a running speed of a ventilation fan is controlled before a predetermined time prior to the expected arrival time to the spot at which the outside air temperature increases or drops suddenly.

10. The vehicle air-conditioning control method of claim 9, wherein opening/closing of a damper provided in an outside air intake opening is controlled before the predetermined time prior to the expected arrival time to the spot at which the outside air temperature increases or drops suddenly.

11. The vehicle air-conditioning control method of claim 9, wherein a running speed of an indoor fan is controlled before the predetermined time prior to the expected arrival time to the spot at which the outside air temperature increases or drops suddenly.

12. The vehicle air-conditioning control method of claim 9, wherein control is changed before a predetermined distance from the spot at which the outside air temperature increases or drops suddenly rather than before the predetermined time prior to the expected arrival time to the spot at which the outside air temperature increases or drops suddenly.

13. The vehicle air-conditioning control method of claim 1, wherein the preceding vehicle precedes the vehicle on a same line.

* * * * *